United States Patent [19]

Garceau et al.

[11] 4,426,070

[45] Jan. 17, 1984

[54] COIL SPRING ASSEMBLY WITH GRID AND BASE FRAME

[75] Inventors: Ronald Garceau, Southbridge; Henry R. Ramsey, Dudley, both of Mass.

[73] Assignee: Webster Spring Co., Inc., Oxford, Mass.

[21] Appl. No.: 297,772

[22] Filed: Aug. 31, 1981

[51] Int. Cl.[3] ..... A47C 23/053

[52] U.S. Cl. ..... 267/91; 267/110; 5/267

[58] Field of Search ..... 267/91, 92, 93, 94, 267/95, 96, 97, 98, 99, 100, 101, 106, 110, 111, 112, 133, 167, 178, 179; 5/248, 256, 257, 267, 269, 271, 272, 273, 275, 276, 277, 464, 475

[56] References Cited

U.S. PATENT DOCUMENTS

| | | | |
|---|---|---|---|
| 530,248 | 12/1894 | Stoll | 5/267 |
| 819,671 | 5/1906 | Pennepacker | 5/276 |
| 2,791,783 | 5/1957 | Rymland | 5/275 |
| 3,270,354 | 9/1966 | Ciampa et al. | 5/275 |
| 3,660,854 | 5/1972 | Garceau | 5/267 |
| 3,864,765 | 2/1975 | Anonauer | 5/267 |
| 3,953,903 | 5/1976 | Lawrence et al. | 5/267 |
| 4,051,567 | 10/1977 | Hutchinson | 5/267 |
| 4,068,330 | 1/1978 | Rakow et al. | 5/267 |
| 4,112,528 | 9/1978 | Higgins | 5/267 |
| 4,236,262 | 12/1980 | Spiller | 5/257 |

FOREIGN PATENT DOCUMENTS

| | | | |
|---|---|---|---|
| 243076 | 11/1925 | United Kingdom | 5/267 |

*Primary Examiner*—Bruce H. Stoner, Jr.
*Assistant Examiner*—R. R. Diefendorf
*Attorney, Agent, or Firm*—Robert T. Gammons

[57] ABSTRACT

A spring assembly comprising a base frame, a grid frame, coils connected at their lower ends and upper ends to the respective frames wherein the grid frame is provided with crossing longitudinal and transverse wires so positioned as to enable spacing the coils transversely of the grid frame at a uniform spacing and wherein the longitudinal wires of the grid frame are provided with deviations for receiving diametral portions of the coils and retaining the latter from movement relative to the grid frame.

8 Claims, 8 Drawing Figures

COIL SPRING ASSEMBLY WITH GRID AND BASE FRAME

BACKGROUND OF INVENTION

Spiller U.S. Pat. No. 4,236,262 discloses a spring assembly wherein there is a base frame, a grid frame and coils connected at their lower ends to the base frame and at their upper ends to the grid frame. The grid frame includes longitudinally and transversely-extending right angular crossing wires welded at their crossings. The transversely-extending wires are arranged in groups of three with relatively wide spaces between groups and the longitudinal wires are arranged singularly at a wider space transversely of the grid than the groups of three wires longitudinally of the grid. The effect of this arrangement is to provide a structure which is prone to sag longitudinally where the heaviest load is applied and wherein sagging is least desirable. One of the purposes of this invention is to provide an arrangement of grid wires which will be most resistant to sagging longitudinally in a plane where the load is greatest. A further object is to provide for attaching coils to the grid wires as thus arranged which will not require notching the top loops of the coils. Another object is to provide for attaching the coils in spaced or overlapping relation. A still further object is to provide for attaching the coils to the grid wires in both odd and even numbers without modifying the arrangement of wires, that is, to enable employing a grid with a specific arrangement of wires which will enable positioning the coils in a number of different patterns.

SUMMARY OF INVENTION

As herein illustrated, the spring assembly comprises, in combination, a base frame, a grid frame provided with transversely and longitudinally-extending grid wires crossing at right angles and coils attached at their lower ends to the base frame and at their upper ends to the wires of the grid frame wherein the longitudinal wires are spaced apart a distance less than half the diameters of the top loops of the coils and the transverse wires are positioned in pairs spaced longitudinally of the grid frame, each pair being spaced apart a distance greater than the diameters of the top loops of the coils and wherein the coils are attached to portions of the longitudinal wires in the spaces between the pairs of transverse wires with diametral portions of the loops overlying the intermediate wires of three adjacent longitudinal wires and the diametral portions at right angles thereto underlying the longitudinal wires at opposite sides of the intermediate longitudinal wires and said longitudinal wires at opposite sides of the intermediate longitudinal wires containing deviations for receiving the underlying diametral portions of the loops so that they lie in substantially the same plane as the overlying portions. The disposition of the longitudinal and transverse wires is such that an odd number of coils can be spaced at equal distances from each other transversely of the grid to provide an 81 coil assembly or 63 coil assembly in which the coils are spaced apart transversely equal distances from each other. With the same arrangement, coils can be attached to successive groups of three adjacent longitudinal wires or can be attached in overlapping relation. The deviations in the longitudinally-extending wires comprise longitudinally-spaced, upwardly-displaced portions with undisplaced portions therebetween. The crossing longitudinally and transversely-extending wires define transverse rows of seats comprising three adjacent longitudinal wires and two adjacent transverse rows wherein the longitudinal wires of the seat are equally spaced and comprise an intermediate wire and a wire at each side thereof and the two wires at each side of the intermediate wire are spaced apart a distance less than the diameters of the tops of the loops. The two longitudinal wires are spaced at a distance which is greater than the diameter of the top loops of the coils.

The invention will now be described in greater detail with reference to the accompanying drawings, wherein.

Figure 1:
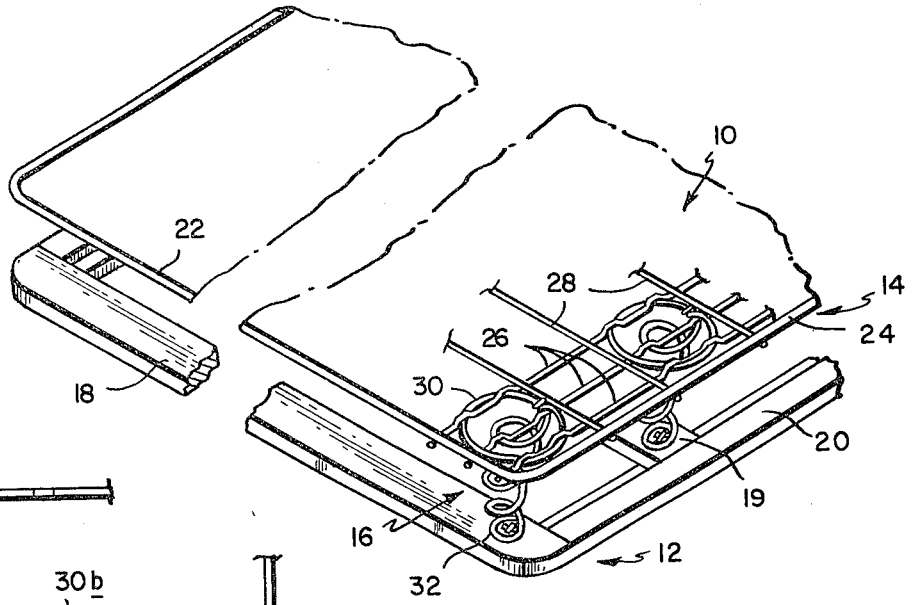
FIG. 1 is a perspective of a portion of a spring assembly constructed according to this invention.
Figure 5:
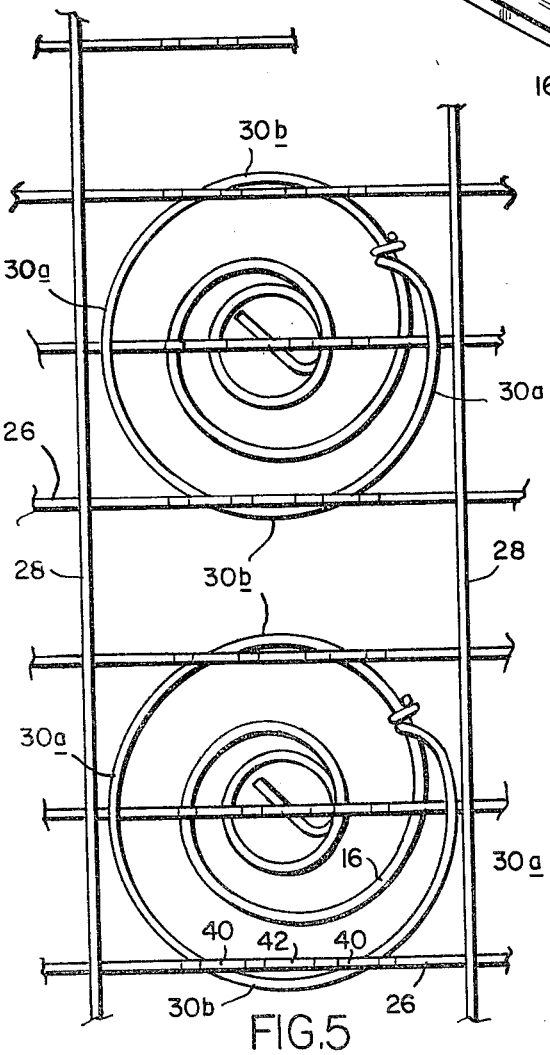
FIG. 5 is a plan view of an assembly made according to the invention with the coils spaced apart with a single space between coils.

Referring to the drawings, FIG. 1, there is shown in perspective a fragmentary portion of a spring assembly 10 comprising a base frame 12, a grid frame 14 and a plurality of coil springs 16. The base frame 12 is of rectangular configuration, being narrower than long, and is comprised of spaced, parallel end members 18—18 and spaced, parallel side members 20—20. Between the end members there are longitudinally-spaced parallel bars 19 fastened at their opposite ends to the side members 20—20. The base frame 12 is, desirably, made of wood, although other materials could be used for this purpose.

The grid frame 14 comprises a rectangular border wire having spaced, parallel ends 22—22 and spaced, parallel sides 24—24 of substantially the same transverse and longitudinal dimensions as the base frame 12. In addition, the grid frame has longitudinally and transversely arranged wires 26 and 28 which cross at right angles to each other and which are attached at their ends to the border wire and to each other at their crossings by means, for example, of welding. The longitudinally-positioned wires 26 are spaced transversely of the grid at equal spacing from each other and the transversely-positioned wires 28 are disposed in pairs with the pairs spaced at equal spacing from each other. The distance between the pairs of wires is less than the distance between the wires of the pairs.

The coil springs 16 which are positioned between the base frame and the grid are of conical configuration provided with top loops 30 which are of larger diameter than the bottom loops 32 and are positioned between the base frame and the grid with the top loops 30 secured to the wires of the grid frame and the bottom loops 32 fastened to the end members 18—18 and the bars 19 of the base frame 12.

In accordance with one aspect of this invention, the grid frame 14 is so designed as to enable making several arrangements of coils transversely of the grid frame in which the coils are uniformly-spaced transversely of the grid frame. In each of these arrangements, the number of coils transversely of the grid is an odd number.

Figure 8:
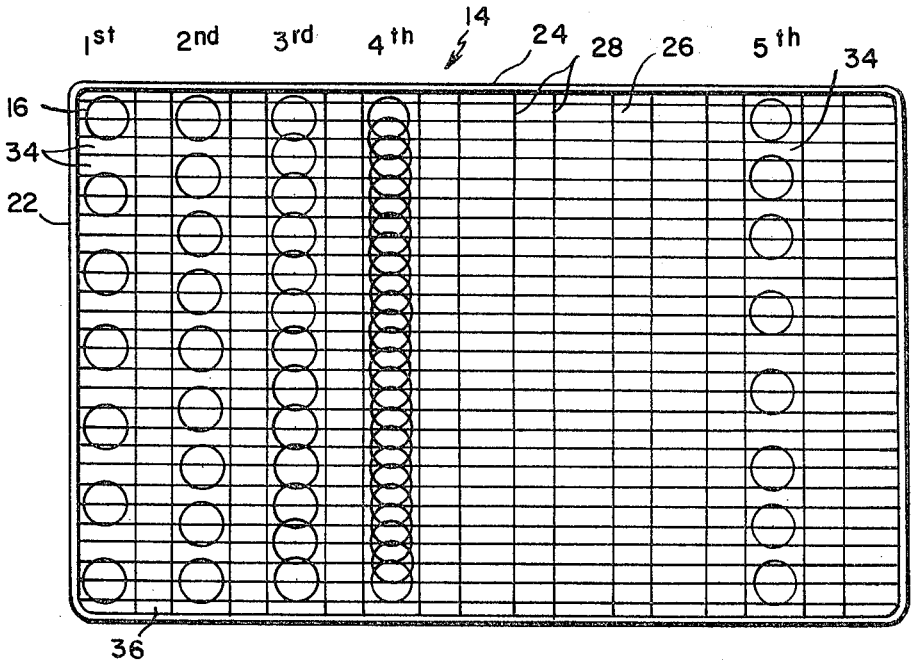
FIG. 8 is a diagrammatic view in plan of the top of the spring assembly showing various possible arrangements of the coils positioned transversely thereof.

Referring specifically to FIG. 8, there is shown a first arrangement of coils wherein the coils are positioned transversely with the two spaces 34—34 between adjacent coils; a second arrangement wherein the coils are positioned with a single space 34 between adjacent coils; a third arrangement in which the coils are positioned with no spaces between adjacent coils; and a fourth arrangement wherein the coils are positioned in overlapping relation. In all of the arrangements mentioned, there is an odd number of coils transversely of the grid. In each of the aforesaid arrangements, the transverse row of coils are spaced longitudinally of the grid frame by an empty row of spaced defined by the space between the pairs of spaced transverse rows.

It is also possible to position the coils transversely of the grid frame in even numbers as shown, for example, in a fifth arrangement, FIG. 8, with three coils spaced apart a single space 34 starting at each side of the grid frame and two coils spaced from each other by two spaces 34—34 and from the groups of three coils by two spaces. This arrangement provides for greater stiffness along the sides of the assembly.

In order to attach the coils to the grid wires, the longitudinally-positioned grid wires 26 are provided with deviations 38 in those portions of their length located between the wires 28 of each pair of transverse wires. These deviations 38 comprise longitudinally-spaced, upwardly-displaced portions 40—40 between which there is an undisplaced portion 42. The depth of the upwardly-displaced portions 40—40 is approximately equal to twice the thickness of the wire of which the coils are made. The portions of the wires 26 between the pairs of transverse wires 28 are undeviated. The top loops 30 of the coils contain no deviations and so, in this respect, the structure has the advantage that the coils themselves need not be specially prepared for attachment to the wires of the grid frame.

For the purpose of this invention, the longitudinally-extending wires 26 are spaced apart a distance less than half the diameters of the top loops of the coils so that, when a coil is placed astride any three adjacent wires 26, the center of the coil lies on the centrally-located wire 26*a* of three wires 26 with diametral portions 30*a*—30*a* overlying the wire 26*a* and diametral portions 30*b*—30*b* underlying the two wires 26*b*—26*b* at either side of the centrally-located wire 26*a*. As was pointed out above, the wires 28 of the transversely-positioned pairs of wires are spaced at a greater distance than the diameter of the top loops, while the spacing between the pairs of wires 28 is less than the diameters of the top loops of the coils.

As thus constructed, the seats against which the top loops of the coils are secured comprise any three adjacent longitudinal portions of the longitudinal wires and the two transverse portions of the crossing transverse wires. The coils are positioned with the upper loops 30 against the seats so that they are centered within the seats at equal distances from the transversely-spaced wires, with diametral portions 30*a*—30*a* overlying the centrally-located longitudinal wire 26*a* of the group of three wires and with diametral portions 30*b*—30*b* at right angles thereto underlying the two longitudinal wires 26*b*—26*b* either side of the centrally-located longitudinal wire 26*a*. The diametral portions 30*b*—30*b* of the top loops extend beyond the wires 26*b*—26*b* at either side of the centrally-located wire 26*a* through the deviations 40—40 from the inner side to the outer side and back to the inner side.

Figure 2:
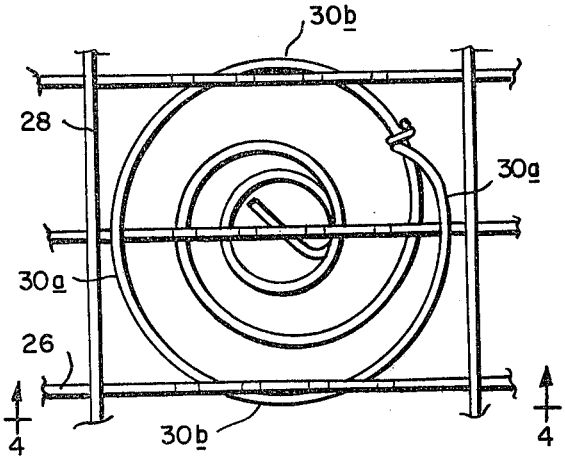
FIG. 2 is a plan view of a fragmentary portion of the assembly showing the attachment of a single coil to the grid forming the other component of the assembly.
Figure 3:
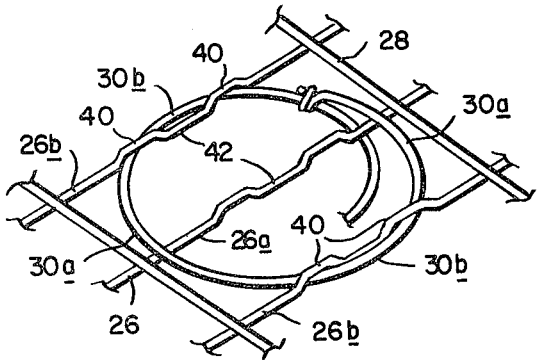
FIG. 3 is a perspective of FIG. 2.
Figure 4:
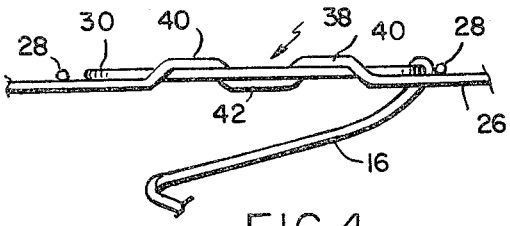
FIG. 4 is an elevation taken on the line 4—4 of FIG. 2.
Figure 6:
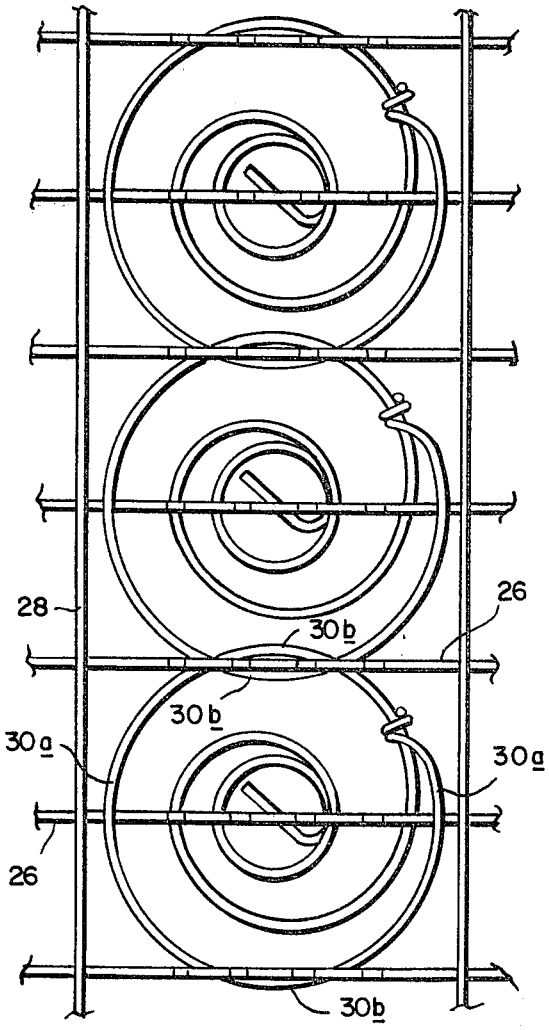
FIG. 6 is a plan view showing the coils in adjacency.
Figure 7:
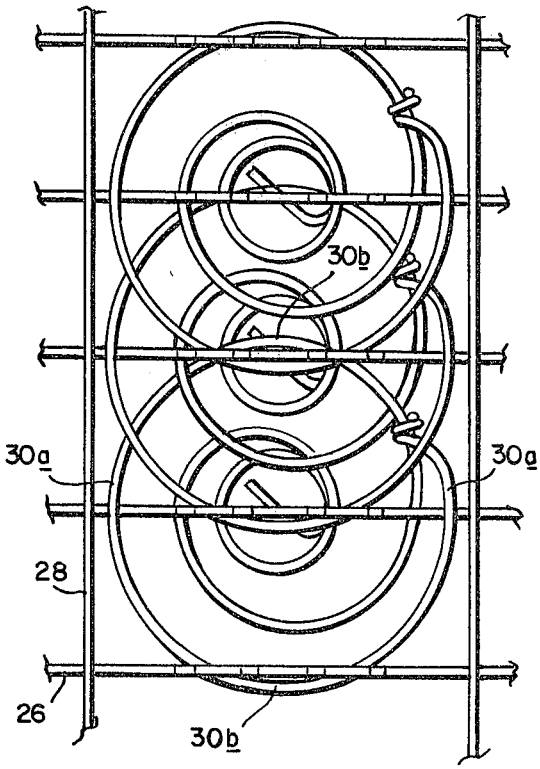
FIG. 7 is a plan view with the coils overlapping.

FIGS. 2 and 3 show the coils as they are attached to the grid wires either with a single space between coils or with two spaces between coils. FIG. 6 shows an arrangement wherein there is no space between coils. In this arrangement, the relatively short arcuate portions 30*b*—30*b* which extend beyond the wires 26 overlap the corresponding portions of the adjacent coils. FIG. 7 shows an arrangement wherein the top loops overlap to the extent that the coils of adjacent coils are centered on successive longitudinal wires 26. This arrangement provides a very stiff assembly. The arrangement of the coils at the different spacing can be mixed to provide such beneficial results as stiffness in center areas and softness in other areas.

It should be understood that the present disclosure is for the purpose of illustration only and includes all modifications or improvements which fall within the scope of the appended claims.

What is claimed is:

1. A spring assembly comprising, in combination, a rectangular grid and coil springs attached thereto, said rectangular grid comprising a border wire and longitudinally and transversely spaced wires attached at their ends to the border wire and at their crossings to each other and said coil springs having top and bottom loops with the top loops attached to the wires on the grid, said transversely spaced, longitudinally extending wires being arranged at a spacing which is less than half the diameter of the top loops of the coils, said longitudinally spaced, transversely extending wires being arranged in pairs with the spaces between pairs less than the diameters of the top loops of the coils and the spaces between the wires of pairs of wires greater than the diameters of the top loops of the coils, said transversely spaced, longitudinally extending wires underlying the pairs of transversely extending wires and being secured thereto at their crossings, the portions of the transversely spaced, longitudinally extending wires between each pair of transversely extending wires containing deviating and non-deviating portions, the deviating portions being displaced upwardly and being located equidistant from the transversely extending wires with a non-deviating portion therebetween, said top loops of the coils defining uninterrupted loops of greater diameter than the distance between any two transversely spaced wires at opposite sides of an intermediate longitudinally extending wire and of less diameter than the distance between the wires of any pair of transversely extending wires such that when the coil is mounted to a seat defined by three longitudinally extending, transversely spaced wires crossing a pair of transversely extending, longitudinally spaced wires, arcuate portions of the top loop will overlie the intermediate one of the longitudinally extending wires inwardly of the transversely extending wires and arcuate portions of the loop at right angles thereto will extend through the deviations of the longitudinally extending wires beyond the longitudinally extending wires.

2. A spring assembly according to claim 1 wherein the coils can be attached to successive groups of three adjacent longitudinal wires.

3. A spring assembly according to claim 1 wherein the coils can be attached to overlapping groups of three adjacent longitudinal wires.

4. A spring assembly according to claim 1 wherein the coils are spaced apart transversely of the grid with a space between adjacent coils corresponding to the transverse spacing of the wires.

5. A spring assembly according to claim 1 wherein the coils are positioned transversely of the grid with the diametral portions of adjacent coils overlapping a common wire.

6. A spring assembly according to claim 1 wherein the coils are spaced transversely of the grid such as to overlap in the space defined by adjacent wires.

7. A spring assembly according to claim 1 characterized in that the disposition of the longitudinal and transverse wires is such that an odd number of coils can be spaced at equal distances from each other transversely of the grid to provide an 81 coil assembly wherein the coils are spaced apart transversely at equal distances from each other.

8. A spring assembly according to claim 1 characterized in that the disposition of the longitudinal and transverse wires is such that an odd number of coils can be spaced at equal distances from each other transversely of the grid to provide a 63 coil assembly wherein the coils are spaced apart transversely at equal distances from each other.

* * * * *